US006762730B2

(12) United States Patent
Schadler

(10) Patent No.: US 6,762,730 B2
(45) Date of Patent: Jul. 13, 2004

(54) CROSSED BOW TIE SLOT ANTENNA

(75) Inventor: John L. Schadler, Raymond, ME (US)

(73) Assignee: SPX Corporation, Charlotte, NC (US)

( * ) Notice: Subject to any disclaimer, the term of this patent is extended or adjusted under 35 U.S.C. 154(b) by 0 days.

(21) Appl. No.: 10/263,684

(22) Filed: Oct. 4, 2002

(65) Prior Publication Data

US 2004/0066345 A1 Apr. 8, 2004

(51) Int. Cl.[7] ..... H01Q 13/10
(52) U.S. Cl. ..... 343/770; 343/853
(58) Field of Search ..... 343/767, 770, 343/853

(56) References Cited

U.S. PATENT DOCUMENTS 2,935,747 A * 5/1960 Ghose ..... 343/767
3,623,162 A * 11/1971 Whitty ..... 343/767
6,424,309 B1 * 7/2002 Johnston et al. ..... 343/767

* cited by examiner

*Primary Examiner*—Michael C. Wimer
(74) *Attorney, Agent, or Firm*—Baker & Hostetler LLP

(57) ABSTRACT

An antenna includes conductive panels pierced with bow-tie-shaped cutouts (long axis vertical) fed at the narrow point of the cutout to achieve horizontal polarization. Each two panels are configured at right angles as an 'X' when viewed from above. The radiation pattern from each panel is a peanut shape; with a hybrid phase shifter to feed each pair in quadrature, the combined pattern is omnidirectional. Multiple crossed-cutout modules can be arranged vertically and fed in parallel to achieve high vertical directivity. The general design permits outdoor application with no supporting mast. The general design is compatible with the power capability and frequency range needed for commercial UHF television broadcast.

19 Claims, 3 Drawing Sheets

CROSSED BOW TIE SLOT ANTENNA

FIELD OF THE INVENTION

The present invention relates generally to transmitting antennas. More particularly, the present invention relates to omnidirectional slot-type transmitting antennas.

BACKGROUND OF THE INVENTION

Broadcasting of radio and television (TV) entertainment programming can be realized with low-power transmitters and close-to-the ground antennas, but characteristically reaches geographically dispersed audiences by using high-power transmitters, tall antenna towers, low-loss transmission lines, and antennas that radiate with high efficiency. Each of these requirements for high performance imposes requirements on the rest of the system, as do the rules imposed by the Federal Communications Commission (FCC), which defines the minimum permissible quality of the transmitted signal as detected at specified distances from the transmitting antenna. TV transmitting antennas, in particular, should exhibit a low voltage standing wave ratio (VSWR) in order to avoid reflecting more than a minimal part of the transmitted signal back into the transmitter, which would cause ghosting and other defects objectionable to advertisers and to viewers of the received signal. TV transmitting antennas should also radiate efficiently, to maximize signal strength in proportion to the power (and cost) of the associated transmitter. TV transmitting antennas should also exhibit good structural properties, such as freedom from corrosion (for long life); small size, light weight, and self-supporting structure (for low tower bulk and wind loading); and rigidity (for constant radiative properties in strong winds).

Slot antennas in a variety of styles are capable of application to commercial use. Typical slot antennas, fed with radio frequency (RF) signals carried to the antennas by coaxial cables or waveguides, use the RF voltage differential across the slot to create a radiating electromagnetic wave. For example, a flat metal plate, incised with a slot of suitable dimensions, with the facing edges of the slot excited by RF of suitable frequency to opposite polarity using a suitable feed method, will radiate at right angles to the plane of the plate, with the polarization of the radiated signal the same as the axis of the RF voltage differential. The radiation pattern created by such a slot antenna is commonly referred to in the art as a "peanut" shape, with equal lobes of high signal strength extending from and perpendicular to the front and back surfaces of the antenna, with signal strength decreasing as angle increases off the axis of radiation, and with the signals at the front and back of the slotted plate of opposite polarity (i.e., 180 degrees out of phase) and essentially equal magnitude. The dimensions of the slot (primarily) and the plate (to a lesser extent) determine the frequency range over which the slot can be excited to radiate; a simple rectangular slot has a single preferential frequency of radiation and performs poorly away from that frequency.

Bow-tie-style dipole antennas can in general exhibit desirable properties for broad band RF transmission and reception. With suitable dimensions, including overall span and the angle of the triangles comprising the bow-tie shape, such antennas can combine good electrical and mechanical performance. When sized for the ultra-high frequency (UHF) television broadcast band, the dimensions of a bow-tie antenna are practical for simple and inexpensive structures. "Broad band" here refers to a single antenna able to operate well over a significant fraction of an octave. UHF television, for example, extends from 470 MHz to 806 MHz, which is most of an octave. Each UHF TV channel has an allowed bandwidth of 6 MHz, which is around 1% of an octave at the middle of the band. A television transmitting antenna that meets FCC requirements over a range of several channels is viewed by those knowledgeable in the art as "broad band"; a voice or data communications transmitting antenna, which would typically transmit a signal narrower in bandwidth than a TV broadcast, should exceed the range of frequencies of a similar TV antenna in order to be considered "broad band" for its duties. A properly dimensioned bow-tie antenna designed for receiving, rather than transmitting, UHF television, by way of contrast, should work adequately over the entire band, due to its less challenging performance requirements.

Multiple antennas can be combined to incorporate the properties of a single antenna and additional advantages as well. For example, two antennas with "peanut"-shaped radiation patterns, mounted at right angles and driven with signals that are 90 degrees apart in phase, can exhibit an omnidirectional radiation pattern comparable to that of a mast dipole, the reference standard. Similarly, two horizontally polarized antennas stacked vertically at a spacing of one wavelength and driven in phase can exhibit a propagation pattern that has greater directivity than a mast dipole, which means a thinner beam of strong signal, reinforcing the tendency for the signal strength near the horizontal to be stronger than that at a downward or upward angle. Adding more antenna elements in this stack can continue to increase the directivity, which can translate to increased reception range for a given transmitter power output.

Combining the designs described above can produce a broadcast antenna comprising a vertical stack of horizontally polarized, crossed bow-tie slot antenna modules. If sized for UHF, such an antenna can be made sturdy and capable of efficiently radiating the power levels needed for commercial broadcast transmission, including television and general communications. Such an antenna can provide an omnidirectional radiation pattern to provide coverage of a commercial user's required service area. Such an antenna can be designed to work well across a broad range of frequencies, rather than requiring unique dimensions for each frequency, potentially offering cost savings. Accordingly, it is desirable to provide a novel stacked omnidirectional crossed bow-tie slot antenna capable of handling commercial power levels, featuring ruggedness, scalable directivity, and the potential for low VSWR at low cost.

SUMMARY OF THE INVENTION

Design concepts existing in the prior art have been combined in a novel and useful way by the present invention, wherein, in a first aspect of the invention, a crossed bow tie slot antenna is comprised of a first conductive rectangular panel, a first bow-tie-shaped slot (two identical isosceles triangles with a common axis of symmetry through their unequal vertices, said vertices proximal to each other, with a parallel-sided slot joining the triangles symmetrically, the figure oriented with the referenced axis vertical) that pierces the first panel, a second conductive rectangular panel rigidly and conductively attached to the first panel at their common vertical axis of symmetry, so that the two panels cross at right angles to each other, and a second bow-tie-shaped slot that pierces the second panel.

In another aspect of the invention, an apparatus for broadcast of ultra-high frequency (UHF) television signals is comprised of first means for radiating a first RF signal with "peanut"-shaped pattern of signal strength versus azimuth, with horizontal polarization, and with power levels compatible with city-wide reception from a single radiative source, as defined by the Federal Communications Commission (FCC); second means for radiating a second RF signal with "peanut"-shaped pattern of signal strength versus azimuth in quadrature with the first means, collocated with the first means, adjusted in phase with respect to the first means so that the combined radiation pattern of the two means constitutes an omnidirectional transmission and meets FCC requirements for public-carrier broadcasting; means for omnidirectional radiation characterized by mutual impedance of elements that results in a voltage standing-wave ratio (VSWR) across the UHF band suitable for broadcast applications; and plurality of means for omnidirectional radiation, so configured as to provide increased power-handling capacity and increased directivity, translating to increased signal strength over a reception region.

In still another aspect of the invention, a radiation method for broadcast transmission is comprised of the steps of accepting a broadcast signal; converting the broadcast signal from a single signal to two signals in quadrature; distributing each of the two quadrature signals uniformly with regard to power and equally with regard to phase among a plurality of signal loads; carrying the load signals to radiative devices via coaxial cabling located in neutral planes; and applying the transmission signals to the radiative devices, such devices consisting of pairs of center-joined, bow-tie-slotted panel radiators, all panels lying in one of two planes in quadrature, each panel radiator in each pair driven by the outer and inner conductor of a coaxial cable with phasing corresponding to its spatial orientation compared to the rest of the radiators.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF PREFERRED EMBODIMENTS OF THE INVENTION

A preferred embodiment of the present invention provides an antenna comprising crossed bow-tie-slotted radiating elements that are sized, phased, and stacked to radiate in the UHF television broadcast band over a comparatively broad range of channel frequencies.

Figure 1:
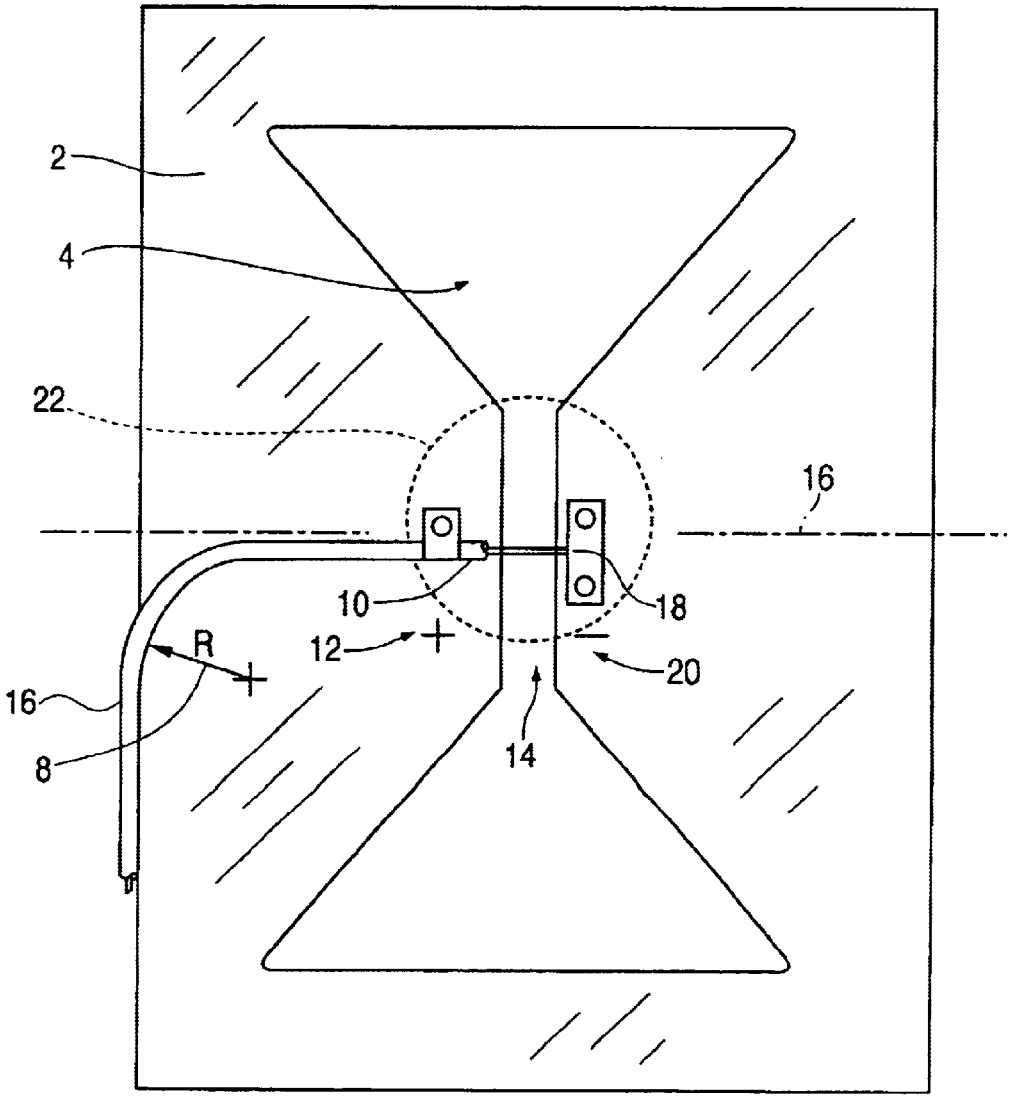
FIG. 1 provides a plan view illustrating the layout of a single panel of a preferred embodiment of an antenna incorporating the present invention.

A preferred embodiment of the present inventive apparatus and method is illustrated in FIG. 1. Here, a conductive plate 2 in which a "bow-tie" pattern 4 as shown has been opened receives RF feed using a coaxial cable 6. A bend radius 8 complies with the cable manufacturer's specifications. An outer conductor termination 10 attaches to a first or "plus" side 12 of a slot 14, part of the cut pattern 4 near the midline, or horizontal axis of symmetry 16. An inner conductor termination 18 attaches to a second or "minus" side 20 of the slot 14. Positioning of coax termination 22 must be offset from the midline 16 of the panel, which, with shape and feed included, constitutes a first antenna element.

In accordance with one embodiment of the present invention, a single-module, single-plane antenna, as shown in FIG. 1, comprises a first conductive rectangular panel 2, and a first bow-tie-shaped slot 4 (two identical isosceles triangles with a common axis of symmetry through their respective unequal vertices, the unequal vertices proximal to each other, with a parallel-sided slot or "neck" joining the triangles, the figure oriented with the referenced axis vertical) pierces the first panel. The single pierced panel constitutes a radiative element; it radiates in a horizontally polarized pattern known as "peanut"-shaped (plotting signal strength versus azimuth) when center-fed with a simple broadcast signal.

Figure 2:
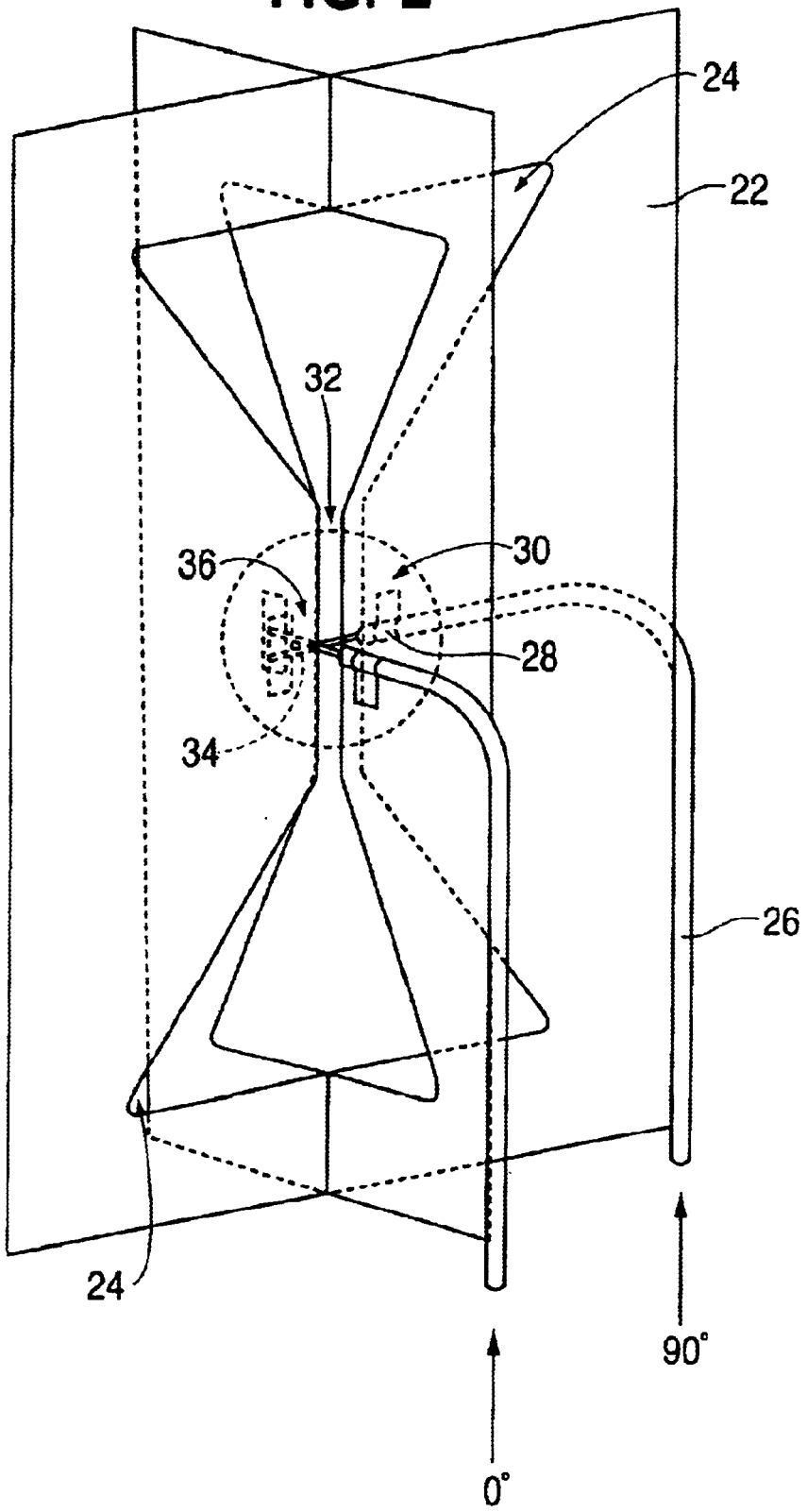
FIG. 2 provides a perspective view with phantom lines, which view illustrates the physical relationship between a pair of panels arranged in quadrature, together comprising a single module of a preferred embodiment of the present invention.

A second view of a preferred embodiment, FIG. 2, adds a second antenna element, comprising thereby a single antenna module. Here, a second panel 22, comprising two halves attached on opposite sides of the first panel, has an open bow-tie pattern 24 that duplicates the pattern in the first panel. A second coaxial cable 26 feeds this second element, with an outer conductor termination 28 bonded to a positive side 30 of a slot 32 and an inner conductor termination 34 bonded to a negative side 36 of the slot 32. As with the first element, the feed must fall near but offset from the horizontal midline, to allow the two feeds to remain electrically isolated from each other as well as from the opposite sides of the slots.

In accordance with another embodiment of the present invention, as shown in FIG. 2, a second conductive rectangular panel 22 is rigidly and conductively attached to the first panel at their common vertical axis of symmetry, so that the two panels cross at right angles to each other. A second bow-tie-shaped slot 24 pierces the second panel. The second panel by itself constitutes a second radiative element. When center-fed with quadrature-phased broadcast signals, the two panels together perform as a single omnidirectional antenna module. The presence of a phase shifter hybrid and of the second radiative element of the antenna achieves impedance cancellation, which permits low VSWR to be achieved over a comparatively broad range of UHF frequencies for a single antenna design and size.

Dimensions of each element 38–44 for the preferred embodiment, as sized for broad band UHF, are approximately 16 inches high with a slot height of approximately 12 inches. Center-to-center height between vertical array elements should be one wavelength at the high end of the working band. "Neck" width and length are inversely proportional, so that a narrower neck behaves as though it was longer. Altering neck dimensions changes the size of the triangles making up the bow tie.

Figure 3:
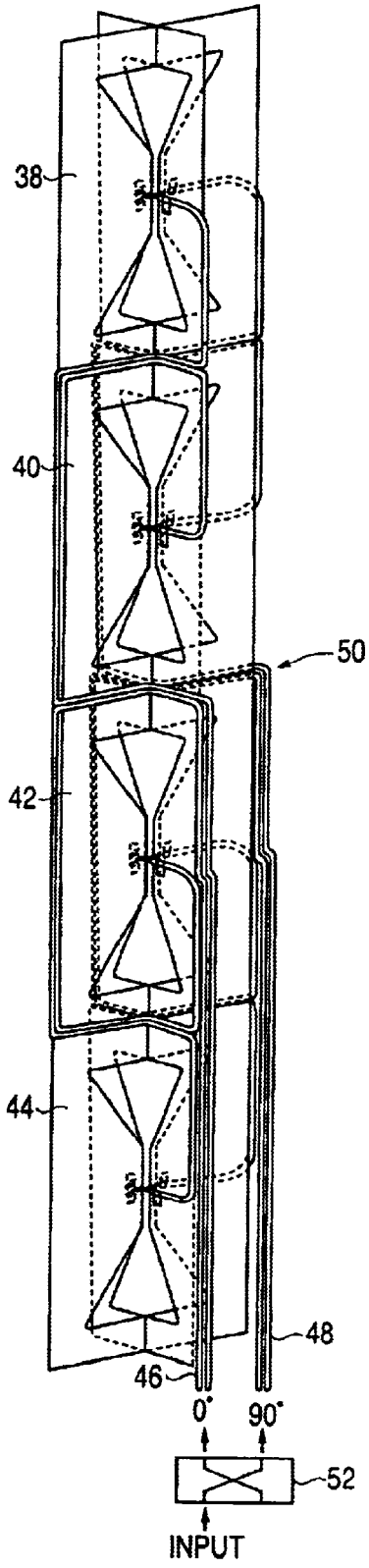
FIG. 3 provides a perspective view with phantom lines, which view illustrates a vertical array of several modules of a preferred embodiment of the present invention.

In FIG. 3, multiple modules are shown stacked. A first module 38 sits at the top of the stack; in this preferred embodiment, a second module 40, a third module 42, and a fourth module 44 make up the complete radiator array. Coaxial cables 46 supporting radiators coplanar with the first radiative element (refer to FIG. 1 element 2) and coaxial cables 48 supporting radiators coplanar with the second radiative element (refer to FIG. 2 element 22) are shown with a center feed 50, so that the cable lengths to all of the modules can be readily made equal. A phase shift and power distribution apparatus 52 is shown in highly schematic form.

In accordance with yet another embodiment of the present invention, a vertical array of antenna modules may be configured and individually center-fed with the same two signals in quadrature. With those elements coplanar with the first element fed in phase from a power divider and those elements coplanar with the second element similarly fed from a quadrature-phased power divider, the directivity of the antenna can increase with the number of modules, which can increase the effective range for a given power level.

In accordance with still another embodiment of the present invention, all of the antenna elements receive feed from individual coaxial cables, all of which are mounted along the edges of the elements, in the "neutral plane", where their metallic structure has slight effect on radiation properties of the whole.

In accordance with another embodiment of the present invention, the individual panels of the antenna, previously shown as flat, solid metal sheets, can be fabricated from multiple conductive sheets made up into a hollow structure, which can permit all of the coaxial cables to be placed inside. The added thickness from implementing such a structure can have negligible effect on radiation properties, while allowing the structure to be entirely self-supporting. The placement of the coaxial signal cables inside the structure can increase weather immunity while ensuring that the antenna has a "clean" environment, that is, free of parasitic radiators and uncontrolled reflecting elements. In this implementation, the coaxial feed to each element slot can emerge directly from the "edge" of that element slot, which edge is itself a face of the fabricated hollow structure.

In accordance with another embodiment of the present invention, the entire antenna can be housed within a radome or equivalent weatherproof housing, transparent to RF.

The antenna design is fully scalable, although limited at the low range of the very high frequency (VHF) television band (channels 2–6) because of the large dimensions involved (elements on the order of three meters tall). For microwave use, element size is on the order of centimeters, which can limit power capacity.

Increased directivity requirements may be met by adding more elements in the vertical array, provided that power dividers of sufficient precision to satisfy element-to-element accuracy needs are incorporated.

Structural considerations are driven by frequency band, environment, and performance requirements. Any conductive material or composite may be used, but must be compatible with wind loading, power level, exposure to corrosive atmospheres and dissimilar metals, and intended lifetime. A single plate may have multiple bow-tie cutouts to implement an array of elements instead of using multiple discrete plates. Size may determine material choice.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described; accordingly, all suitable modifications and equivalents may be resorted to that fall within the scope of the invention.

What is claimed is:

1. A crossed bow tie slot antenna, comprising:

a first conductive rectangular panel, having a first bow-tie shaped slot that pierces said first panel, wherein said slot is comprised of two identical isosceles triangles with a common axis of symmetry through their unequal vertices, said vertices proximal to each other, with a parallel-sided slot joining the triangles symmetrically, the figure oriented with the referenced axis vertical; and a second conductive rectangular panel, rigidly and conductively attached to said first panel at their common vertical axis of symmetry, so that the two panels cross at right angles to each other, having a second bow-tie-shaped slot that pierces said second panel.

2. The antenna of claim 1, further comprising:

a first coaxial cable feeding said first panel; and a second coaxial cable, feeding said second panel.

3. The antenna of claim 1, further comprising:

a plurality of crossed pairs of pierced panels arranged in a uniform vertical array to establish a radiative array.

4. The antenna of claim 3, further comprising:

a signal distribution device to provide RF energy in proper relationship for the feeding of all panels comprising said antenna.

5. The signal distribution device of claim 4, further comprising:

an RF power inlet device, such as a coaxial connector, to accept the broadcast signal to be radiated;

a 90-degree power hybrid, to convert a uniform-phase incoming broadcast signal into two separate broadcast signals in quadrature;

a first output port from said power hybrid, to emit a broadcast signal at the nominal phase angle of said antenna; and a second output port from said power hybrid, to emit a broadcast signal at a phase angle of 90 degrees with respect to said first output port's signal.

6. The signal distribution device of claim 4, further comprising:

a first power divider, providing power distribution from said first output port to the plurality of coaxial cables feeding pierced panels coplanar with said first pierced panel; and a second power divider, providing power distribution from said second output port to the plurality of coaxial cables feeding pierced panels coplanar with said second pierced panel.

7. The signal distribution device of claim 4, further comprising:

a set of interconnection apparatus to provide signal feeds to all signal distribution device subassemblies requiring such feeds; and a set of coaxial output connections from said first and second power dividers sufficient to feed all panels comprising said antenna.

8. The antenna of claim 2, further comprising:

a first end of said first coaxial cable affixed to said first panel, so that the outer conductor of said first end of said first cable is electrically and mechanically bonded to the center of the first edge of said first bow-tie shaped slot, and the center conductor of said first end of said first coaxial cable is electrically and mechanically bonded to the center of the second edge of said first bow-tie shaped cutout.

9. The antenna of claim 2, further comprising:

a run of said first coaxial cable from a first end, initially parallel to and within two cable diameters of the horizontal axis of symmetry of said first panel, then curved with a radius of curvature compliant with the manufacturer's specification for the type of said first coaxial cable, to run parallel to and adjacent to the vertical edge of said first panel, until reaching the extent of said first panel, then continuing, insulated, along horizontal and vertical edges of any other panels as necessary, employing further specification-complaint curves as necessary, alongside any other such coaxial cables, to reach a signal distribution device.

10. The antenna of claim 2, further comprising:

a second end of said first coaxial cable, connected electrically and mechanically to a first signal port from a signal distribution device.

11. The antenna of claim 2, further comprising:

a first end of said second coaxial cable affixed to said second panel, so that the outer conductor of said first end of said second cable is electrically and mechanically bonded to the center of the first edge of said second bow-tie-shaped slot, and the center conductor of said first end of said second coaxial cable is electrically and mechanically bonded t the center of the second edge of said second bow-tie-shaped cutout.

12. The antenna of claim 2, further comprising:

a run of said second coaxial cable from a first end, initially parallel to and within two cable diameters of the horizontal axis of symmetry of said second panel, then curved with a radius of curvature compliant with the manufacturer's specification for the type of said second coaxial cable, to run parallel to and adjacent to the vertical edge of said second panel, until reaching the extent of said second panel, then continuing, insulated, along horizontal and vertical edges of any other panels as necessary, employing further specification-compliant curves as necessary, alongside any other such coaxial cables, to reach a signal distribution device.

13. The antenna of claim 2, further comprising:

a second end of said second coaxial cable, connected electrically and mechanically to a second output port from a signal distribution device.

14. The antenna of claim 3, further comprising:

a plurality of pairs of coaxial cables, all of equal electrical length, feeding a plurality of crossed pairs of pierced panels.

15. An apparatus for broadcast of ultra-high frequency (UHF) television signals, comprising:

first means for radiating a peanut-pattern RF signal with horizontal polarization;

first means for radiating a peanut-pattern RF signal with power levels compatible with city-wide reception from a single radiative source, as defined by the Federal Communications Commission (FCC);

second means for radiating a second peanut-pattern RF signals in quadrature with said first means, collocated with said first means; and second means for radiating a second peanut-pattern RF signal in quadrature with said first means, adjusted in phase with respect to said first means so that the combined radiation pattern of the two means constitutes an omnidirectional transmission meeting FCC requirements for public-carrier broadcasting;

means for omnidirectional radiation wherein mutual impedance of elements results in low voltage standing-wave ratio (VSWR) across the UHF band; and plurality of means for omnidirectional radiation, so configured as to provide increased power-handling capacity and increased directivity, translating to increased signal strength over a reception region, in proportion to the number of elements making up said plurality of means.

16. A radiation method for broadcast transmission, comprising the following steps:

accepting a broadcast signal;

converting the broadcast signal from a single signal to two signals in quadrature;

distributing each of the two quadrature signals uniformly with regard to power and equally with regard to phase among a plurality of signal loads;

carrying the load signals to radiative devices via equal-length coaxial cables located in neutral planes; and applying the transmission signals to the radiative devices, such devices consisting of pairs of center-joined, bow-tie-slotted panel radiators, all panels lying in one of two planes in quadrature, each panel radiator in each pair driven by the outer and inner conductor of a coaxial cable with phasing corresponding to its spatial orientation with respect to the rest of the radiators.

17. The radiation method of claim 16, wherein the broadcast signal is that of a public carrier transmitting television programming in the UHF frequency band.

18. The radiation method of claim 16, wherein the broadcast signal is a data transmission n the UHF frequency band.

19. The radiation method of claim 16, wherein the broadcast signal is a data transmission in the microwave frequency band.

* * * * *

UNITED STATES PATENT AND TRADEMARK OFFICE

CERTIFICATE OF CORRECTION

PATENT NO. : 6,762,730 B2
DATED : July 13, 2004
INVENTOR(S) : John L. Schadler

It is certified that error appears in the above-identified patent and that said Letters Patent is hereby corrected as shown below:

Column 7,
Line 40, replace "t" with -- to --.

Signed and Sealed this

Twenty-third Day of November, 2004

JON W. DUDAS
*Director of the United States Patent and Trademark Office*